United States Patent [19]

Fluck

[11] Patent Number: 4,895,487

[45] Date of Patent: Jan. 23, 1990

[54] CONVEYOR APPARATUS FOR ADVANCING GROUPS OF FLAT ARTICLES, PARTICULARLY BAKED CONFECTIONERY ITEMS

[75] Inventor: René Fluck, Schleitheim, Switzerland

[73] Assignee: SIG Schweizerische Industrie-Gesellschaft, Neuhausen am Rheinfall, Switzerland

[21] Appl. No.: 172,321

[22] Filed: Mar. 23, 1988

[30] Foreign Application Priority Data

Mar. 23, 1987 [CH] Switzerland ..... 1089/87

[51] Int. Cl.[4] ..... B65B 35/44

[52] U.S. Cl. ..... 414/403; 53/532; 53/542

[58] Field of Search ..... 53/242, 542, 532; 414/403, 415; 198/463.2, 463.3, 465.2, 465.3

[56] References Cited

U.S. PATENT DOCUMENTS

| | | | |
|---|---|---|---|
| 2,395,310 | 3/1944 | Willoughby | 53/542 X |
| 3,927,508 | 12/1975 | Campbell | 53/542 X |
| 3,942,303 | 3/1976 | Kristianson | 53/542 |
| 4,209,960 | 7/1980 | Deutschländer et al. | 53/502 |
| 4,219,112 | 8/1980 | Loewenthal | 198/449 |
| 4,394,899 | 7/1983 | Fluck | 198/408 |
| 4,590,743 | 5/1986 | Hardage | 53/542 X |
| 4,736,570 | 4/1988 | Hardage et al. | 53/532 X |

FOREIGN PATENT DOCUMENTS

| | | | |
|---|---|---|---|
| 2402145 | 7/1975 | Fed. Rep. of Germany . | |
| 2419213 | 11/1975 | Fed. Rep. of Germany . | |
| 2826576 | 1/1980 | Fed. Rep. of Germany . | |
| 1413970 | 11/1975 | United Kingdom . | |
| 2044230 | 10/1980 | United Kingdom . | |
| 2158411 | 11/1985 | United Kingdom | 53/542 |

*Primary Examiner*—Andres Kashnikow
*Assistant Examiner*—Kevin P. Weldon
*Attorney, Agent, or Firm*—Spencer & Frank

[57] ABSTRACT

A conveying system having an input end receiving flat, generally disc-shaped articles in a flat-lying orientation and arranged in at least one column of indefinite length and an output end discharging the articles in consecutive article groups wherein each group being formed of a number of face-to-face stacked articles. The conveying system includes a plurality of separate, individual pallets for receiving and supporting the article groups; a stacking device arranged for forming the groups and charging the pallets therewith; an article removal device arranged for emptying the pallets and discharging the article groups removed from the pallets; a first conveyor for advancing charged pallets from the stacking device to the article removal device; a second conveyor for returning empty pallets from the article removal device to the stacking device; and lateral guides extending along the first conveyor for guiding and retaining the pallets thereon.

7 Claims, 3 Drawing Sheets

CONVEYOR APPARATUS FOR ADVANCING GROUPS OF FLAT ARTICLES, PARTICULARLY BAKED CONFECTIONERY ITEMS

BACKGROUND OF THE INVENTION

In the manufacture of baked confectionery items the latter are, between the oven and a packing machine, frequently conveyed over long paths, intermediately stored and arranged in columns which may be redistributed to increase or reduce the column number. Known conveyor apparatus for this purpose are disclosed, for example, in U.S. Pat. Nos. 4,209,960 and 4,219,112.

During the handling of confectionery items in the above identified known apparatus, risks are high that particularly the edges of the delicate items will be damaged.

SUMMARY OF THE INVENTION

It is an object of the invention to provide an improved conveyor apparatus of the above-outlined type which provides for a particularly gentle handling of the items.

This object and others to become apparent as the specification progresses, are accomplished by the invention, according to which, briefly stated, there is provided a conveying system which has an input end receiving flat, generally disc-shaped articles in a flat-lying orientation and arranged in at least one column of indefinite length and an output end discharging the articles in consecutive article groups wherein each group being formed of a number of face-to-face stacked articles. The conveying system includes a plurality of separate, individual pallets for receiving and supporting the article groups; a stacking device arranged for forming the groups and charging the pallets therewith; an article removal device arranged for emptying the pallets and discharging the article groups removed from the pallets; a first conveyor for advancing charged pallets from the stacking device to the article removal device; a second conveyor for returning empty pallets from the article removal device to the stacking device; and lateral guides extending along the first conveyor for guiding and retaining the pallets thereon.

By virtue of the conveyor apparatus according to the invention, the flat, generally disc-shaped, articles are supported on pallets in their transport from the oven to the packing machine. In this manner, a gentle handling thereof is ensured. In addition, the invention makes possible an increase of the efficiency of the entire installation because with the pallets there may be performed a simple intermediate storage and thus the different components of the apparatus may be utilized in an optimal manner. Also, the output of the conveyor apparatus may be increased. Furthermore, the flexibility (versatility) of the conveyor apparatus is improved. Because of the fact that the pallets may be guided in a much simpler manner than article stacks, the possibilities of setting up the apparatus are increased for the given spatial conditions. A conversion to another article shape or group length may be effected in a simple manner by replacing the pallets. Since the pallets designed for different types of articles have, nevertheless, identical external dimensions, no changes need be effected in the conveyor and guide devices when switching over to the conveyance of different articles.

DESCRIPTION OF THE PREFERRED EMBODIMENTS

Figure 1:
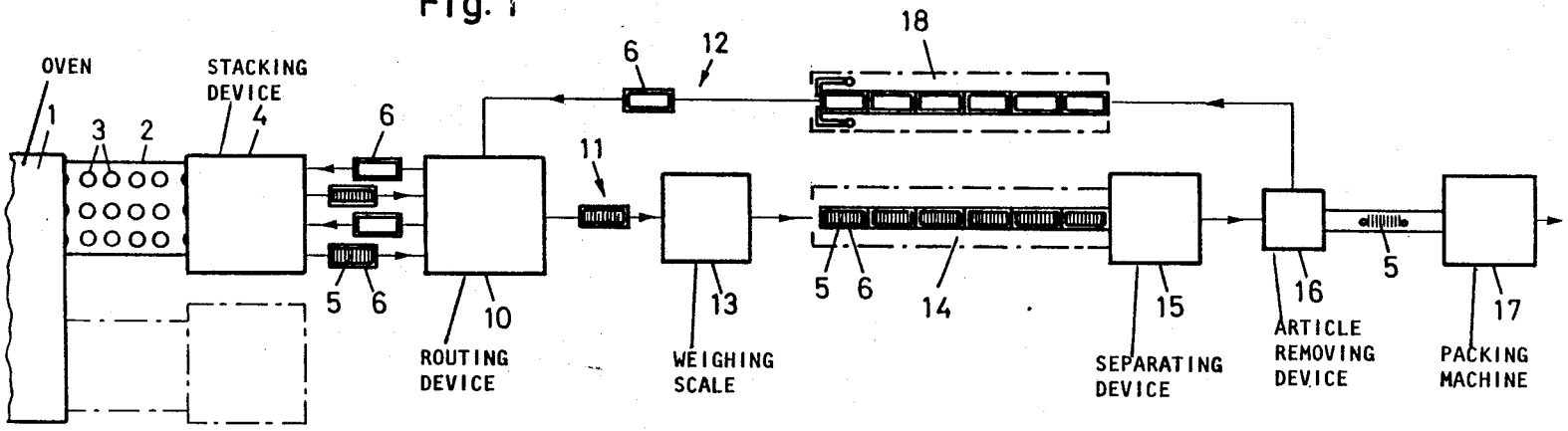
FIG. 1 is a schematic top plan view, in block diagram form, of a preferred embodiment of the invention.

In FIG. 1 there is schematically shown in top plan view a preferred embodiment of the invention. From an oven 1 baked confectionery items 3 are conveyed on a conveyor belt 2 in several columns to a stacking device 4. The stacking device 4 forms two columns of stacked articles 3, for example, in a manner disclosed in British Patent No. 2,044,230. From the stack a predetermined number of articles are taken to form predetermined groups as described, for example, in U.S. Pat. Nos. 4,209,960 or 4,394,899. The groups 5 are placed into pallets 6 in the stacking device 4.

Figure 3:
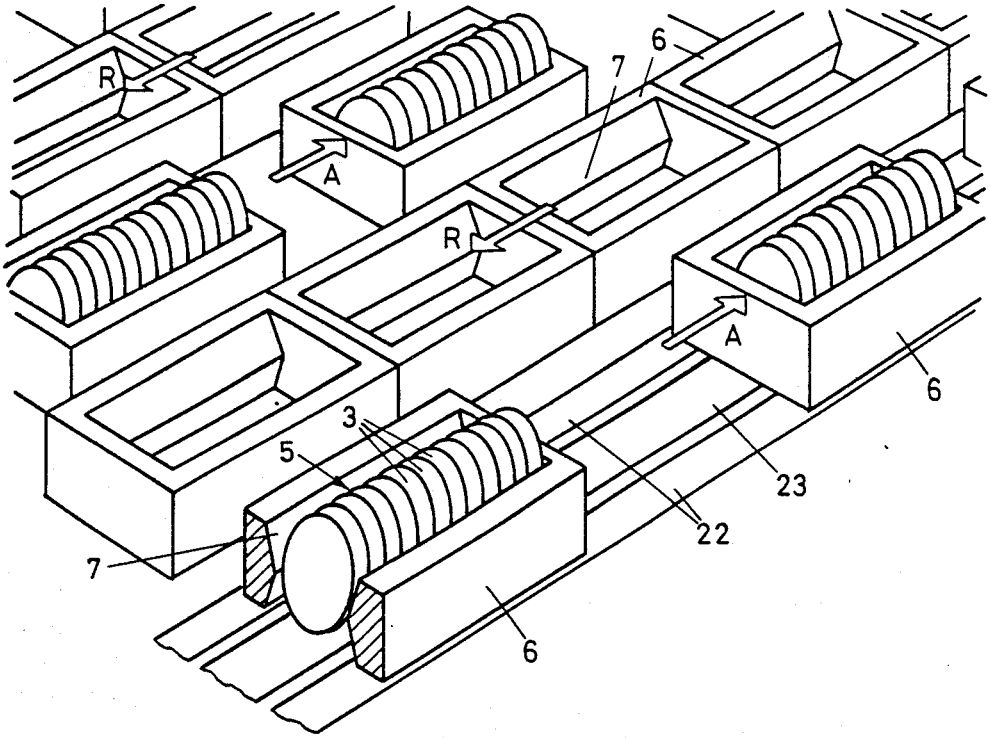
FIG. 3 is a schematic perspective view of one part of the construction illustrated in FIG. 1.

Turning to FIG. 3, the pallets 6 are each formed of a rectangular frame which is made of a synthetic material and which has a throughgoing prismatic opening 7 extending parallel to the frame length between two oppositely located side faces of the pallet 6. The cross-sectional shape of the pallet illustrated in FIG. 3 is particularly designed for charging the article groups 5 at the (open) top and removing them from the (open) bottom of the pallet.

From the stacking device 4 the charged pallets 6 are advanced to a routing device 10 which forms a single column 11 of the charged pallets 6. The routing device 10 furthermore forms from the single returning column 12 of empty pallets two columns which are introduced into the stacking device 4 for charging. Routing devices for such a purpose are described, for example, in German Offenlegungsschriften 2,402,145 and 2,419,213.

The column 11 composed of charged pallets 6 passes through a scale 13 in which the weight of the article stack 5 is monitored. Downstream of the scale 13 (as viewed in the direction of article advance) the pallets 6 are introduced into a storage track 14. In a subsequent separating device 15, such as disclosed, for example, in British Patent No. 1,413,970, the pallets 6 engaging one another edgewise in the storage device 14 are separated and introduced into an article removing device 16. The latter removes the group 5 of articles 3 from the pallet 6 and advances the group to a packing machine 17. The empty pallets are returned to the routing device 10 on a further storage track 18.

Figure 2:
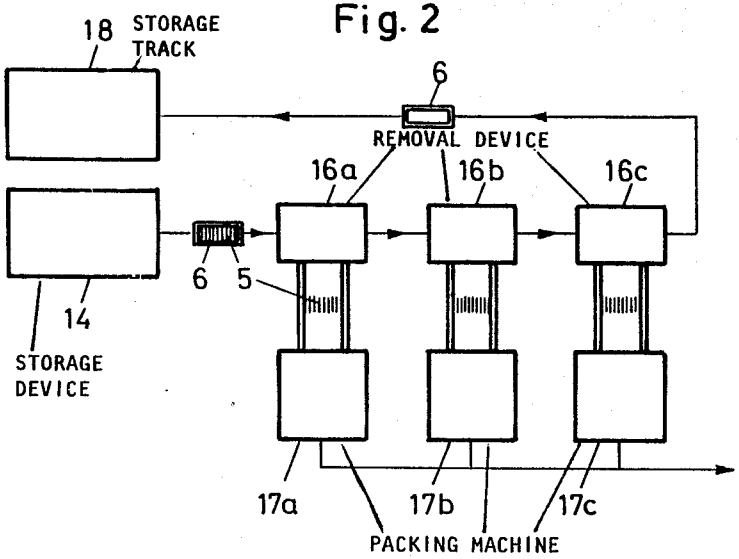
FIG. 2 is a schematic top plan view, in block diagram form, of a variant of the construction shown in FIG. 1.

In the variant illustrated in FIG. 2, the charged pallets 6 arrive, according to their position in the single row, into several removal devices 16*a*, 16*b*, 16*c* in which the article groups 6 are removed from the pallets 6 and advanced to respective packing machines 17*a*, 17*b*, 17*c*.

FIG. 3 illustrates a part of the apparatus shown in FIG. 1 between the stacking device 4 and the routing apparatus 10. The charged pallets 6 advance in the conveying direction A on parallel-spaced conveyor belts 22. The group 5 of articles 3 is supported in the pallets 6 by a third conveyor belt 23 situated between the conveyor belts 22. Such an arrangement has the advantage that when a crowding of pallets occurs, the conveyor belts 22 may continue their run in order to join subsequent pallets 6 to the accumulated pallets, whereas the conveyor belt 23 may be stopped in order to prevent wear on the edges of the articles 3 in the non-moving pallets 6. The empty pallets 6 are moved back to the stacking device 4 on a conveyor belt running in the reverse direction R.

Figure 4:
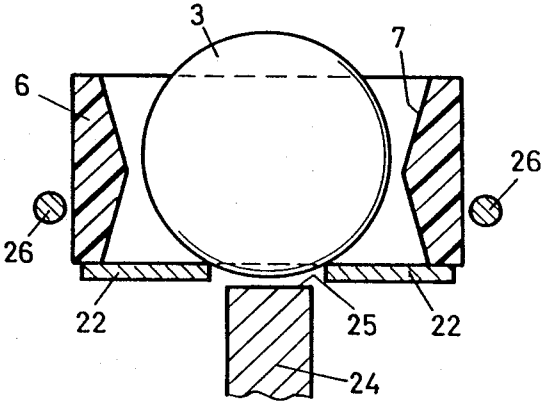
FIG. 4 is a sectional end elevational view of components of the structure shown in FIG. 3.

Turning now to FIG. 4, there is illustrated a variant for controlling the pallet accumulation. During transport, the two spaced conveyor belts 22 support not only the pallets 6 but also the items 3. Between the belts 22 there is arranged a bar 24 which may be raised from its shown withdrawn position so that its upper face 25 is situated immediately below the surface of the conveyor belts 22. In such a position of the bar 24 the items 3 are lifted off the conveyor belts 22 so that they are protected from frictional wear. The pallets 6, as shown in FIG. 4, may be guided in a simple manner, for example, by laterally arranged bars 26.

Figure 5:
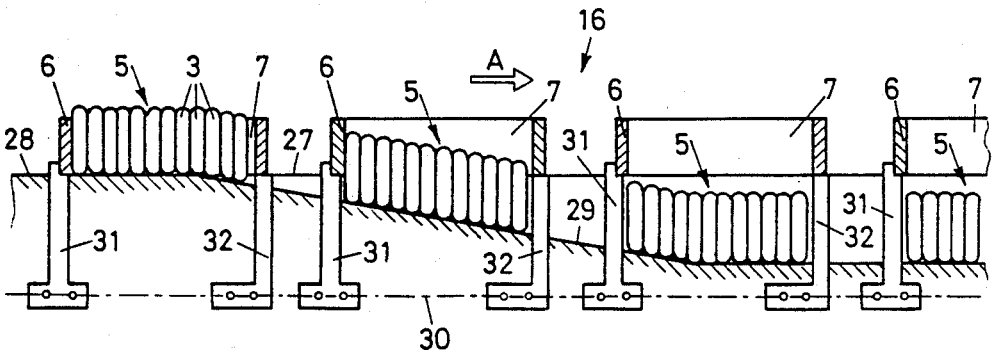
FIG. 5 is a schematic sectional side elevational view of an article-removing device of the preferred embodiment of FIG. 1.

Turning to FIG. 5, there is shown an embodiment of a device 16 for removing the article groups 5 from the pallets 6. Each pallet 6 lies, along two spaced marginal bottom zones thereof, on two spaced support surfaces 27 which extend in a single plane. Between the supporting surfaces 27 there is arranged a guide track 28 on which the articles 3 are supported. The track 28 has, relative to the support surfaces 27, an inclined ramp 29 oriented in the conveying direction A. Underneath the supporting surface there extends a conveyor chain 30 on which pairwise upwardly projecting bars 31, 32 are secured. The bars project through a longitudinal slot of the guide track 28. The trailing bar 31 of the bar pair projects upwardly beyond the support surface 27 and pushes the pallet 6 it engages, on the support 27 in the direction A. The group 5 of articles 3 is supported between each pair of bars 31 and 32 at the outwardly oriented face of the trailing and leading article 3 of the group 5. The inner distance between the bars 31, 32 of one bar pair is slightly greater than the length of the opening 7 in the pallet 6. In this manner, the groups 5 of the articles 3 are taken out of the pallets 6 and are advanced groupwise to the packing machine 17. The empty pallets are shifted, by a non-illustrated pusher, laterally onto a conveyor belt which runs in the direction R and which constitutes a storage track 18.

The charging arrangement in the stacking device 4 for placing the groups 5 into the pallets 6 may be structured similarly to the removal device 16 except that the ramp is oriented in the opposite direction, that is, it ascends in the conveying direction.

Figure 6:
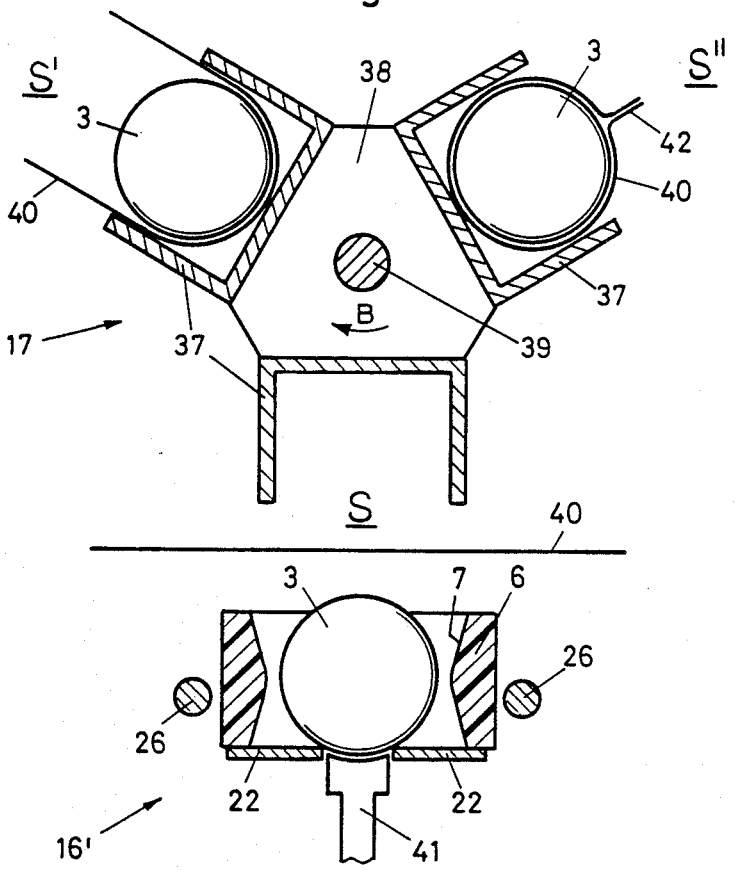
FIG. 6 is a schematic sectional end elevational view of another preferred embodiment of an article-removing device.

In FIG. 6 there is shown another embodiment of an article removal device 16' integrated in a packing machine 17. The charged pallets 6 arrive on two laterally spaced conveyor belts 22 into the article removal device 16' in which they are stopped by a non-illustrated abutment. Above the article removal device 16' there are shown three U-shaped, outwardly open receiving members 37. The receiving members 37 are mounted on a common carrier 38 which is intermittently rotated (indexed) through 120° about a horizontal shaft 39 in the direction of the arrow B. The receiving members 37, the carrier 38 and the shaft 39 thus form a turret-like receiving unit 37*a*. In the illustrated initial position, a wrapper sheet 40 is held between the article removing device 16' and the receiving unit. The group of articles 3 is, by a pusher 41, moved upwardly out of the pallet 6 and, together with the wrapper 40, pushed into the aligned receiving member 37, dwelling in station S. Upon withdrawal of the pusher 41 the carrier 38 performs its rotary indexing motion. In the subsequent station S' the projecting edges of the sheet 40 are welded together by a non-illustrated sealing device to form a longitudinal seam 42 and in a third station S" the packaged article group is taken out of the receiving member 37.

Figure 7:
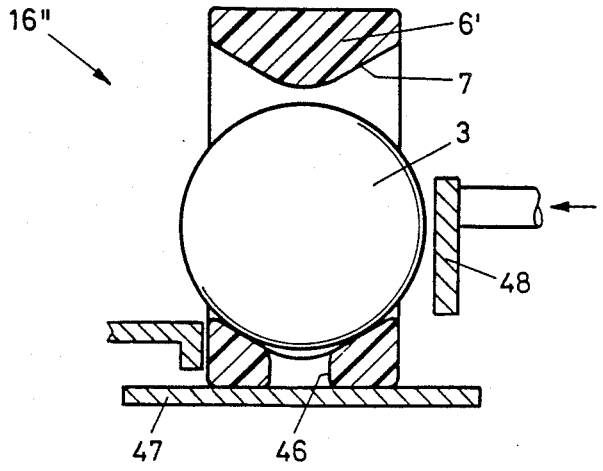
FIG. 7 is a schematic sectional end elevational view of another preferred embodiment of an article-removing device.

Turning to FIG. 7, there is shown therein a third variant of an article removing device 16". The pallet 6' is provided with an opening 7' which is of concave configuration on one side. The associated side wall of the pallet has a throughgoing aperture 46 along the entire length of the opening 7'. The pallet 6' may be utilized similarly to the earlier-described pallet 6, but it is also adapted to carry articles on a conveyor belt in an upright position as shown in FIG. 7. The aperture 46 prevents crumbs from accumulating in the base of the opening 7'. A pusher 48 is provided for laterally removing the article group from the pallet 6'. The pallet 6' filled with a group of articles 3 may be turned from the upright position shown in FIG. 7 before a removal station into a position as shown in FIG. 4 and thus the group of articles may be removed in a manner as shown in FIG. 5.

The present disclosure relates to subject matter contained in Swiss Patent Application No. 1089/87-2 (filed Mar. 23rd, 1987) which is incorporated herein by reference.

It will be understood that the above description of the present invention is susceptible to various modifications, changes and adaptations, and the same are intended to be comprehended within the meaning and range of equivalents of the appended claims.

What is claimed is:

1. A conveying system having an input end receiving flat, generally disc-shaped articles in a flat-lying orientation and arranged in at least one column of indefinite length and an output end discharging the articles in consecutive article groups wherein each group being formed of a number of face-to-face stacked articles, comprising (a) a plurality of separate, individual pallets including means for receiving and supporting therein said article groups; each pallet being open at a pallet face;

(b) a stacking device arranged for forming said groups and charging the pallets therewith;

(c) an article removal device arranged for emptying the pallets and discharging, through said output end, the article groups removed from the pallets; said article removal device comprising (1) two parallel-spaced support faces supporting each pallet at opposite marginal zones at said pallet face;

(2) means for moving the pallets on said support faces in an advancing direction;

(3) a ramp situated between said support faces and extending in said advancing direction; said ramp being arranged for engaging said articles projecting through the pallets; said ramp having a downward slope in said advancing direction, whereby the articles move out gradually from the pallets upon movement thereof in said direction of advance; and (4) article supporting means moving in synchronism with said means for moving the pallets; said article supporting means being arranged for supporting, at opposite leading and trailing end faces, each article group as it moves out on the ramp from the respective said pallet;

(d) first conveyor means for advancing charged pallets from said stacking device to said article removal device;

(e) second conveyor means for returning empty pallets from said article removal device to said stacking device; and (f) lateral guiding means extending along at least said first conveyor means for guiding and retaining said pallets on said first conveyor means.

2. A system as defined in claim 1, wherein said first conveyor means comprises a pallet storage track means disposed between said stacking device and said article removal device.

3. A system as defined in claim 1, wherein said first conveyor means comprises a routing means disposed between said stacking device and said article removal device.

4. A system as defined in claim 1, further comprising a monitoring means connected into said first conveyor means between said stacking device and said article removal device.

5. A system as defined in claim 1, wherein said first conveyor means comprises two parallel-spaced, codirectionally running conveyor belts having coplanar conveying faces; said conveyor belts supporting each pallet at opposite marginal bottom zones thereof.

6. A system as defined in claim 5, wherein said pallet face is supported by said conveyor belts; further comprising a bar extending between said conveyor belts parallel therewith, said bar having a downwardly withdrawn position in which said bar is located sufficiently below said conveying faces of said conveyor belts to remain out of contact with the articles held in the pallets and engaging directly said conveying faces; said bar having an upwardly advanced position in which said bar lifts said articles off said conveyor belts.

7. A system as defined in claim 5, wherein said pallet face is supported by said conveyor belts; further comprising an additional conveyor situated between said two conveyor belts and codirectionally therewith; said additional conveyor being arranged for engaging the articles held in the pallets.

* * * * *